US006568603B2

(12) United States Patent
Chao

(10) Patent No.: US 6,568,603 B2
(45) Date of Patent: May 27, 2003

(54) PROSTRATE WATER SPRINKLER

(76) Inventor: Hui-Chen Chao, 75, Liau Tsuo Hsiang, Liau Tsuo Li, Lu Kang Chen, Chan Hua Hsien (TW)

( * ) Notice: Subject to any disclaimer, the term of this patent is extended or adjusted under 35 U.S.C. 154(b) by 0 days.

(21) Appl. No.: 09/801,577

(22) Filed: Mar. 9, 2001

(65) Prior Publication Data

US 2002/0130204 A1 Sep. 19, 2002

(51) Int. Cl.[7] ..... B05B 3/16

(52) U.S. Cl. ..... 239/242; 239/247; 239/548; 239/587.1

(58) Field of Search ..... 239/242, 246, 239/247, 273, 380, 450, 538, 548, 556, 566, 570, 589, 587.1

(56) References Cited

U.S. PATENT DOCUMENTS

| | | | | | |
|---|---|---|---|---|---|
| 2,943,796 | A | * | 7/1960 | Smith | 239/242 |
| 3,115,305 | A | * | 12/1963 | Rinkewich | 239/242 |
| 3,282,509 | A | * | 11/1966 | Starr | 239/242 |
| 3,767,118 | A | * | 10/1973 | Oberto et al. | 239/242 |
| D282,769 | S | * | 2/1986 | Lemkin et al. | D23/8 |
| 4,632,313 | A | * | 12/1986 | Rinkewich | 239/242 |

* cited by examiner

*Primary Examiner*—Michael Powell Buiz
*Assistant Examiner*—Dinh Q. Nguyen
(74) *Attorney, Agent, or Firm*—Harrison & Egbert

(57) ABSTRACT

A prostrate water sprinkler includes a base on which one or more spray tubes are disposed. The spray tubes are provided with a plurality of jet nozzles which are arranged in one or two rows along the longitudinal direction of the spray tubes. The jet nozzles can adjust the spray angle thereof by an adjustment member which is mounted on the spray tubes.

3 Claims, 5 Drawing Sheets

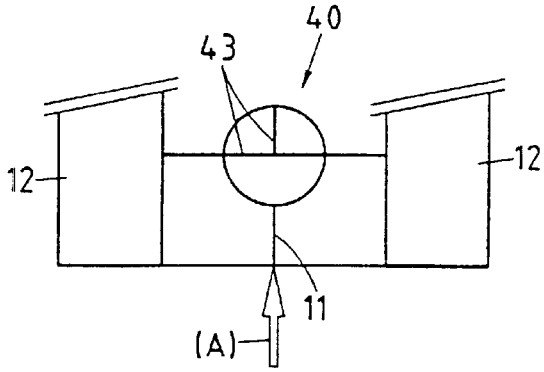
FIG.4-A
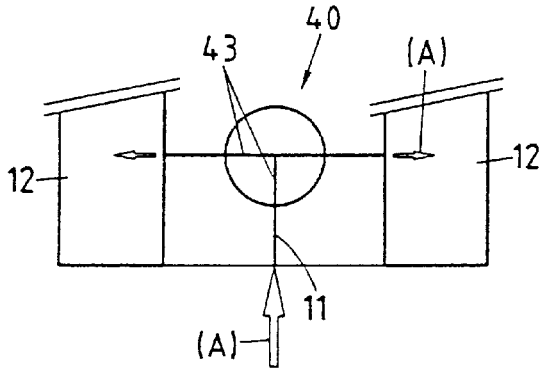
FIG.4-B
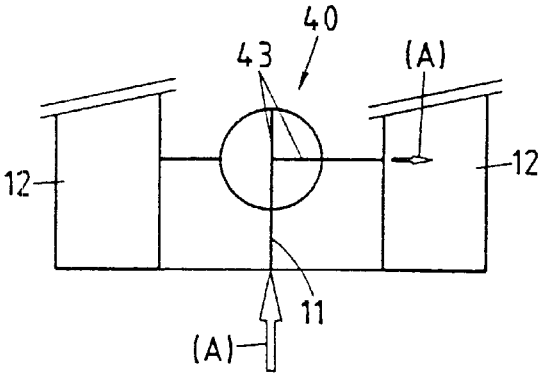
FIG.4-C
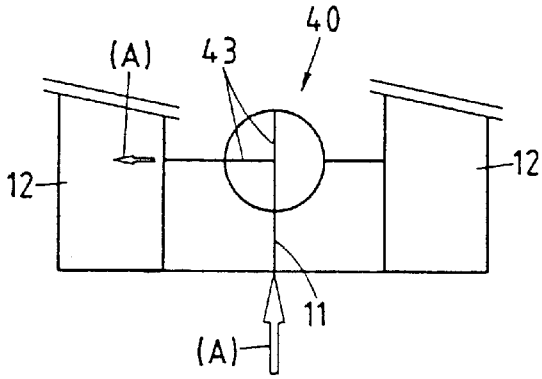
FIG.4-D

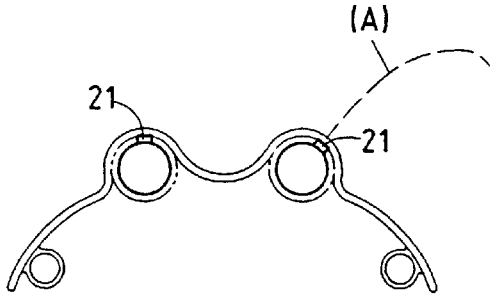
FIG.5-A
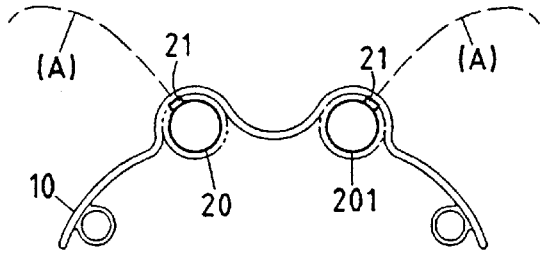
FIG.5-B
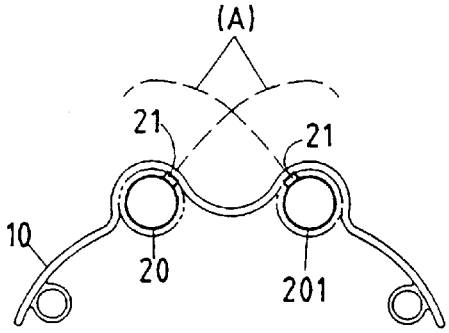
FIG.5-C
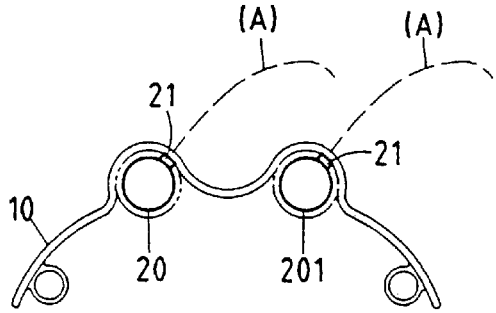
FIG.5-D
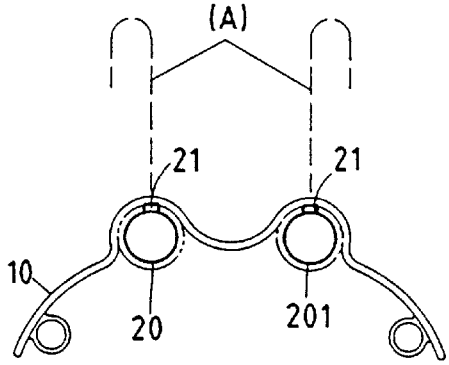
FIG.5-E

PROSTRATE WATER SPRINKLER

BACKGROUND OF THE INVENTION

1. Field of the Invention

The present invention relates generally to a gardening implement, and more particularly to a prostrate lawn sprinkler.

2. Description of Related Art

The conventional prostrate lawn sprinkler comprises only one spray tube, which is provided with a plurality of jet nozzles for emitting water and can adjust its spray pattern. In light of being equipped with only one spray tube, the conventional prostrate lawn sprinkler is not efficient at best.

BRIEF SUMMARY OF THE INVENTION

The primary objective of the present invention is to provide a prostrate water sprinkler free of the shortcoming of the conventional prostrate water sprinkler described above.

The prostrate water sprinkler of the present invention comprises a base on which two or more spray tubes are mounted. The spray tubes are provided with a plurality of jet nozzles which differ in water-emitting angles to promote the water-spraying efficiency of the present invention.

The objective, features, and functions of the present invention will be more readily understood upon a thoughtful deliberation of the following detailed description of the present invention with reference to the accompanying drawings.

BRIEF DESCRIPTION OF THE SEVERAL VIEWS OF THE DRAWINGS

FIGS. 4A–4D are sectional schematic views of a control valve of the present invention in action.

FIGS. 5A–5E are sectional schematic views of the spray tubes of the present invention in action.

DETAILED DESCRIPTION OF THE INVENTION

Figure 1:
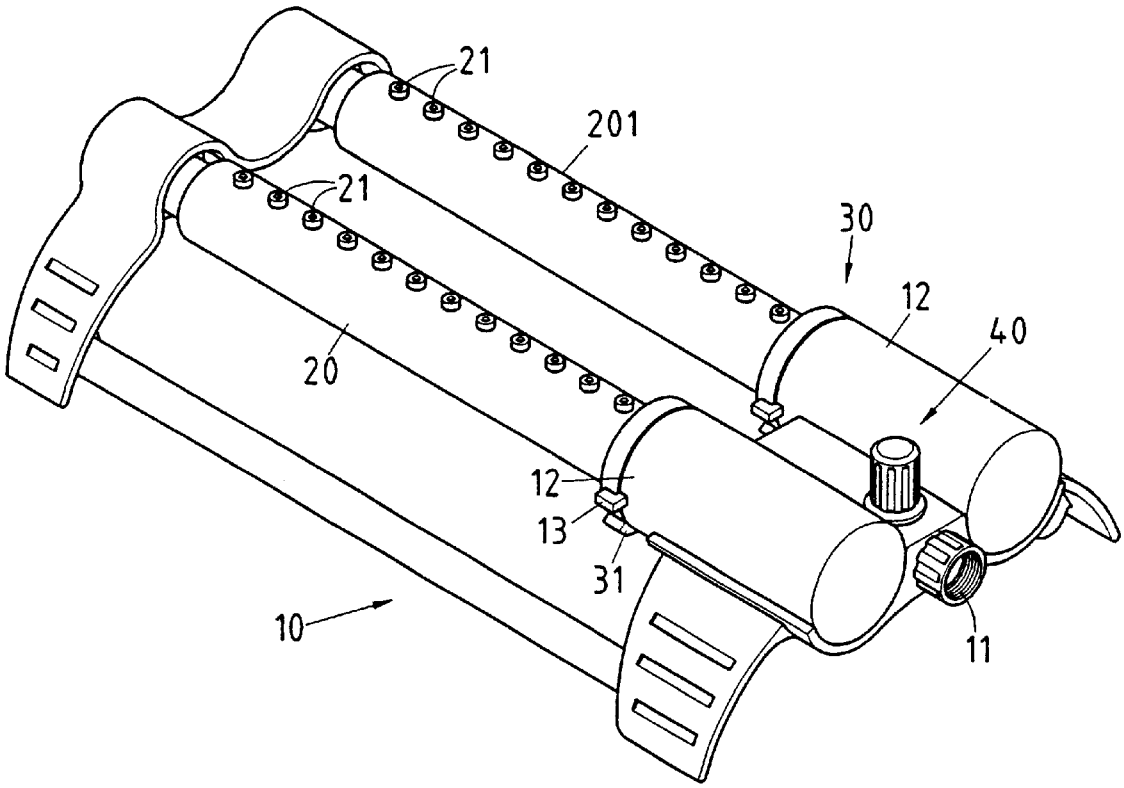
FIG. 1 shows a perspective view of the present invention.
Figure 2:
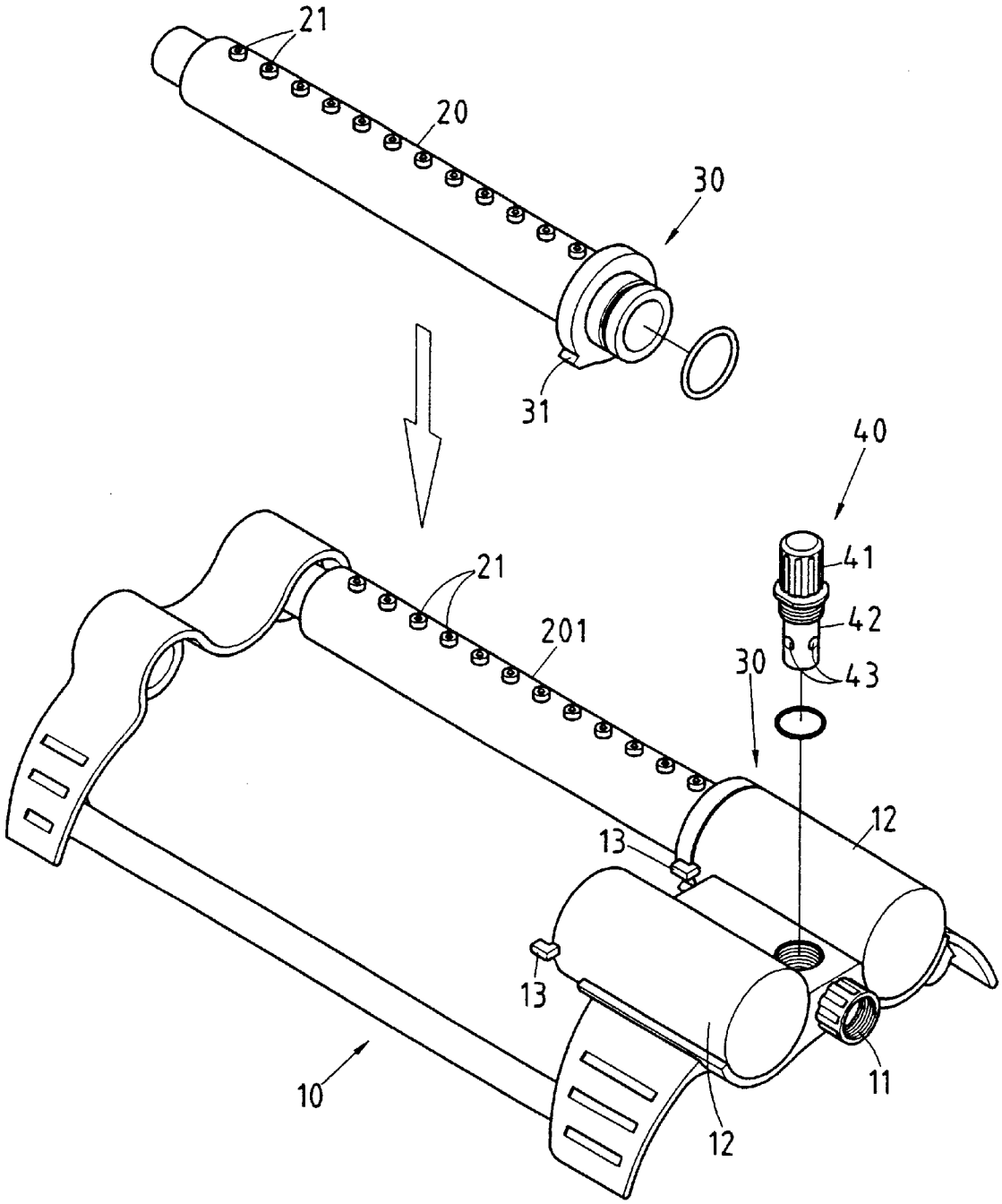
FIG. 2 shows an exploded perspective view of the present invention.

As shown in FIGS. 1 and 2, a prostrate water sprinkler of the present invention comprises a base 10 and two spray tubes 20 and 201.

The base 10 is provided at one end with a hose connector 11 and two locating members 12. The hose connector 11 is in communication with the spray tubes 20 and 201. The two locating members 12 are intended to position the spray tubes 20 and 201, which are mounted on the base 10. The locating members 12 are provided in the inner end thereof with a stop block 13 extending therefrom.

The spray tubes 20 and 201 are similar in construction and are provided with plurality of jet nozzles 21 which are arranged in a row along the longitudinal direction thereof. The spray tubes 20 and 201 are further provided at one end with an adjustment member 30 which is in turn provided with a lug 31 corresponding in location to the stop block 13 of the locating members 12. The adjustment member 30 is comprised of an annular member with a side positioned adjacent an end of the tubular locating member and is mounted on one end of the spray tubes 20 and 201. The spray tubes 20 and 201 are located on the base 10 by the locating members 12 such that the lug 31 of the adjustment member 30 corresponds in location to the stop block 13 and can be stopped by the stop block 13. The lug 31 extends radially outwardly of the annular member. The adjustment member 30 is intended to adjust the spray angle of the jet nozzles 21 of the spray tube 20 or 201. The stop block 13 of the locating members 12 and the lug 31 of the adjustment member 30 are intended to confine the adjustment of spray angle of the spray tubes 20 and 201. In other words, the rotational angle of the spray tube 20 or 201 is confined by the lug 31 of the adjustment member 30 and the stop block 13 of the locating member 12.

Figure 3:
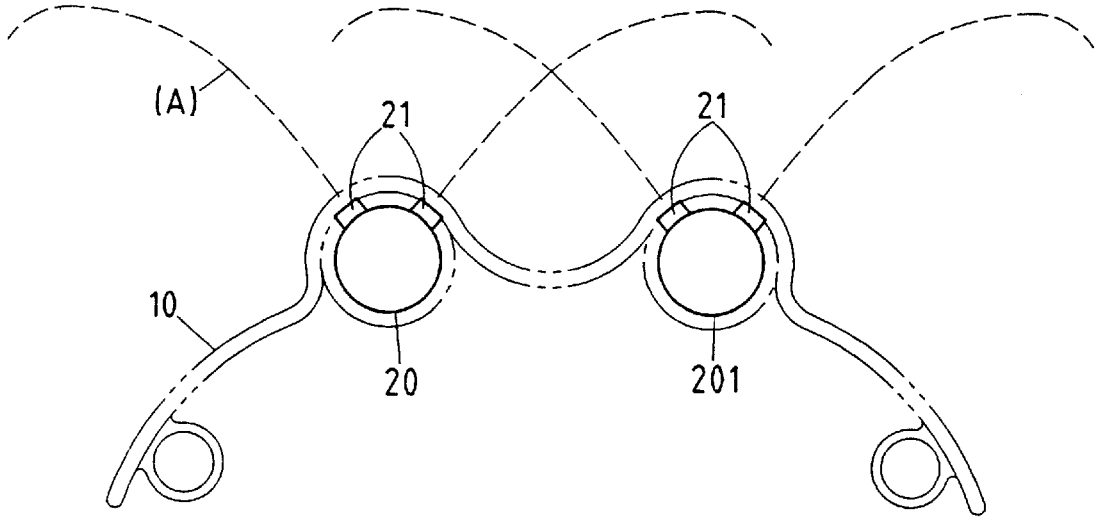
FIG. 3 shows a sectional schematic view of the spray tubes of the present invention in action.

As illustrated in FIG. 3, the spray tubes 20 and 201 of the present invention are provided with a plurality of jet nozzles 21 which are arranged in two rows along the longitudinal direction thereof. The jet nozzles of one row of the spray tube differ in spray angle from the jet nozzles of another row of the same spray tube, as illustrated by the dotted curves "A". In light of such an arrangement of jet nozzles, the watering efficiency of the present invention is greatly improved.

The base 10 of the present invention is further provided at one end with a water-distributing valve 40 in communication with the hose connector 11 and the spray tubes 20 and 201. As shown in FIGS. 4A–4D, the water-distributing valve 40 controls the distribution of water (A) to the spray tubes 20 and 201. The valve 40 has a knob 41 and a water-distributing rod 42 which is provided with two distribution holes 43, as shown in FIG. 2. As a result, the water (A) can be distributed to only one spray tube or two spray tubes at the same time. The supply of the water (A) to the spray tubes can be completely terminated by the valve 40, as shown in FIG. 4A.

In view of the spray tubes 20, 201, the specific arrangement of the jet nozzles 21 and the spray tubes 20 and 201, the adjustment members 30, and the water distributing valve 40, the prostrate water sprinkler of the present invention is capable of various spray patterns, as illustrated in FIGS. 5A–5E.

I claim:

1. A prostrate water sprinkler comprising:

a base having a hose connector at one end thereof, said base having a pair of tubular locating members mounted thereon in spaced parallel relation, each of said pair of tubular (locating members having a stop block extending radially outwardly therefrom;

a pair of spray tubes having respective ends thereof received within said pair of tubular locating members, said pair of spray tubes mounted in spaced parallel relationship on said base, said pair of spray tubes being in communication with said hose connector, each of said pair of spray tubes having a plurality of jet nozzles arranged in a row extending in a longitudinal row along the spray tube; and an adjustment means affixed adjacent to an end of each of said pair of spray tubes, said adjustment means being an annular member having a side positioned adjacent an end of the tubular locating member, said adjustment means having a lug extending radially outwardly of said annular member, and adjustment means for manually adjusting a spray angle of said plurality of jet nozzles of the spray tube, said adjustment means for rotating the spray tube to a position in which said stop block abuts said lug.

2. The sprinkler of claim 1, said base having a water distributing valve in communication with said base connector and said pair of spray tubes.

3. The sprinkler of claim 1, said plurality of jet nozzles comprising a first row of jet nozzles and a second row of jet nozzles on each of said pair of spray tubes extending longitudinal along the spray tube, said first row of jet nozzles having a spray angle that is different than a spray angle of said second row of jet nozzles.

* * * * *